US005525074A

United States Patent [19]

Tsuji et al.

[11] Patent Number: 5,525,074

[45] Date of Patent: Jun. 11, 1996

[54] PANEL MOUNTED CONNECTOR

[75] Inventors: Masanori Tsuji; Motohisa Kashiyama, both of Shizuoka-ken, Japan

[73] Assignee: Yazaki Corporation, Tokyo, Japan

[21] Appl. No.: 273,807

[22] Filed: Jul. 12, 1994

[30] Foreign Application Priority Data

Jul. 12, 1993 [JP] Japan ..... 5-171515

[51] Int. Cl.[6] ..... H01R 13/74

[52] U.S. Cl. ..... 439/555; 439/557

[58] Field of Search ..... 439/554, 555, 439/557, 558

[56] References Cited

U.S. PATENT DOCUMENTS

| | | | |
|---|---|---|---|
| 3,569,909 | 3/1971 | Garver | 439/557 |
| 3,753,212 | 8/1973 | Yamada et al. | 439/557 |
| 5,372,523 | 12/1994 | Sakatani et al. | 439/557 |

FOREIGN PATENT DOCUMENTS 2-36188 3/1990 Japan .

*Primary Examiner* Gary F. Paumen

*Attorney, Agent, or Firm* Wigman, Cohen, Leitner & Myers

[57] ABSTRACT

A panel mounted connector removably mountable to an opening of a panel includes: a male connector (43); and a female connector (41) mated with the male connector. The female connector includes a female connector housing (45) formed with an engagement hood portion (47) having an inner cavity engaged with the male connector and an outer periphery engaged with the mount opening (51) of the panel (P). The engagement hood portion is further formed with a pair of hood cutout portions (53, 55). The female connector housing is further formed with a pair of flexible lock arms (57, 59), each having a lock claw (61, 63) engageable with an edge of the opening of the panel at a free end thereof, for locking the female connector with the panel. When locked with the panel opening, the lock claws are kept pinched between the engaged male connector and the edge of the panel opening within the hood cutout portions formed in the engagement hood portions, respectively.

13 Claims, 6 Drawing Sheets

PANEL MOUNTED CONNECTOR

BACKGROUND OF THE INVENTION

Field of the Invention

The present invention relates to a panel mounted connector which can be mounted on a panel.

Description of the Related Art

FIGS. 1A, 1b, 2A and 2B show an example of prior art panel mounted connector disclosed in Japanese Published Unexamined (Kokai) Utility Model Application No. 2-36188. The prior art panel mounted connector 1 is composed of a panel mounted connector (a connector plug) 3 fixed to a panel P, a mated connector 5 coupled to this connector plug 3, and a connector fixture 9 for mounting the connector plug 3 into a panel mount hole 7.

The connector plug 3 is composed of a connector housing 11 formed with a terminal accommodating chamber for accommodating terminal members and an engagement hood portion 13 formed integral with the connector housing 11. The engagement hood portion 13 is formed with an engagement guide 15 at the end surface thereof. This engagement guide 15 is engagement with the mated connector 5.

The mated connector 5 is provided with a plurality of engagement connection portions 19 engagement with the terminal members accommodated in the terminal accommodating chamber of the connector plug 3. The mated connector 5 can be engagement with the connector plug 3 and further can be inserted into a mount hole 7 formed in the panel P.

The connector fixture 9 is of rectangular cylindrical shape formed with two opposing openings 25 and 27 at both ends thereof, and formed with a pair of lock arms 29 and 31 on the outer peripheral thereof integral therewith. These lock arms 29 and 31 are both formed with lock claws 33 and 35 at the ends thereof. These lock arms 29 and 31 are inserted into two respective rectangular through holes 21 and 23 formed on both the upper and lower sides of the panel P.

When the connector plug 3 is required to be engagement with the mated connector 5, first the engagement guide 15 of the connector plug 3 is engaged with the mated connector 5, and then the mated connector 5 is inserted into the mount hole 7 of the panel P. After that, the connector fixture 9 is attached to the connector plug 3 and further moved toward the mated connector 5 to insert the two lock arms 29 and 31 into the two through holes 21 and 23 until the lock claws 33 and 35 can be locked with the opening edges of the through holes 21 and 23, respectively.

In the prior art panel mounted connector 1 as described above, however, since the connector plug 3 is locked with panel P only with the lock claws 33 and 35 of the lock arms 29 and 31, the locking force is relatively weak. In addition, since the lock claws 33 and 35 are inserted into the through holes 21 and 23 by force, after the lock claws 33 and 35 have been once removed from the through holes 21 and 23, there exists a problem in that the lock claws 33 and 35 are easily damaged and thereby not usable again. Further, since the lock claws 33 and 35 project considerably away from the panel P, a large mounting space is inevitably required.

SUMMARY OF THE INVENTION

With these problems in mind, it is therefore an object of the present invention to provide a panel mounted connector small in the mounting space, large in the panel locking force, and further mountable to the panel repeatedly.

To achieve the above-mentioned object, the present invention provides a panel mounted connector removably mountable to an opening of a panel, comprising: a male connector; and a female connector mated with said male connector, including: a female connector housing formed with an engagement hood portion having an inner cavity engagement with said male connector and an outer periphery engagement with the opening of the panel, the engagement hood portion being further formed with a pair of hood cutout portions; and a pair of flexible lock arms formed with a lock claw engageable with an edge of the opening of the panel at a free end thereof respectively, for locking said female connector with the panel, when locked with the panel opening, said two flexible lock claws being kept pinched between said engaged male connector and the edge of the panel opening within the hood cutout portions formed in the engagement hood portions, respectively.

When the panel mounted connector according to the present invention is mounted on the panel, first the flexible lock arms are locked with the opening of the panel, and thereafter the mated male connector is engagement with the engagement hood portion of the female connector housing. Under these conditions, the flexible lock arms are pinched between the engaged male connector and the opening edge of the panel and further disposed within the hood cutout portions formed in the engagement hood portion of the female connector housing.

When the panel mounted connector is removed from the panel, after the mated male connector has been removed from the engagement hood portion of the female connector housing, the flexible lock arms are deformed largely inward within the hood cutout portions until the lock claws are unlocked from the edge of the panel opening.

As described above, in the panel mounted connector according to the present invention, under the condition that the mated male connector is engaged with the engagement hood portion of the female connector, since the flexible lock arms are kept pinched between the mated male connector and the edge of the panel opening, it is possible to restrict the deformation of the flexible lock arms; that is, to prevent the flexible lock arms from being deformed, thus improving the locking force of the panel mounted connector. Further, after the panel mounted connector has been removed from tile panel opening, since the flexible lock arms will not be damaged, it is possible to stably mount the connector to the panel repeatedly. Furthermore, since the locking arms are housed within the cutout portions formed in the engagement hood portions of the female connector housing, it is possible to reduce the mounting space of the connector.

BRIEF DESCRIPTION OF THE DRAWINGS

FIGS. 1A and 1B are perspective views showing a prior art panel mounted connector, in which FIG. 1A shows a panel mounted connector and a connector fixture and FIG. 1B shows a mated connector engaged with the panel mounted connector;

FIGS. 2A and 2B are side cross-sectional views for assistance in explaining the mounting procedure of the prior art panel mounted connector, in which FIG. 2A shows the state where the mated connector is engaged with the panel mounted connector (connector plug), and FIG. 2B shows the state where the lock arms of the connector fixture are locked with the panel mount hole to fix the panel mounted connector to the panel;

FIGS. 5A, 5B, and 5C are cross-sectional views for assistance in explaining the mounting procedure of the panel mounted connector according to the present invention, in which FIG. 5A shows the state where the panel mounted-connector is not yet mounted to the panel, FIG. 5B shows the state where the lock arms are locked with the panel mount holes to mount the panel mounted connector into the panel mount holes, and FIG. 5C shows the state where the mated connector is engaged with the panel mounted connector mounted into the panel mount holes.

DETAILED DESCRIPTION OF THE EMBODIMENTS

The embodiments of the panel mounted connector according to the present invention will be described hereinbelow with reference to the attached drawings.

Figure 1A:
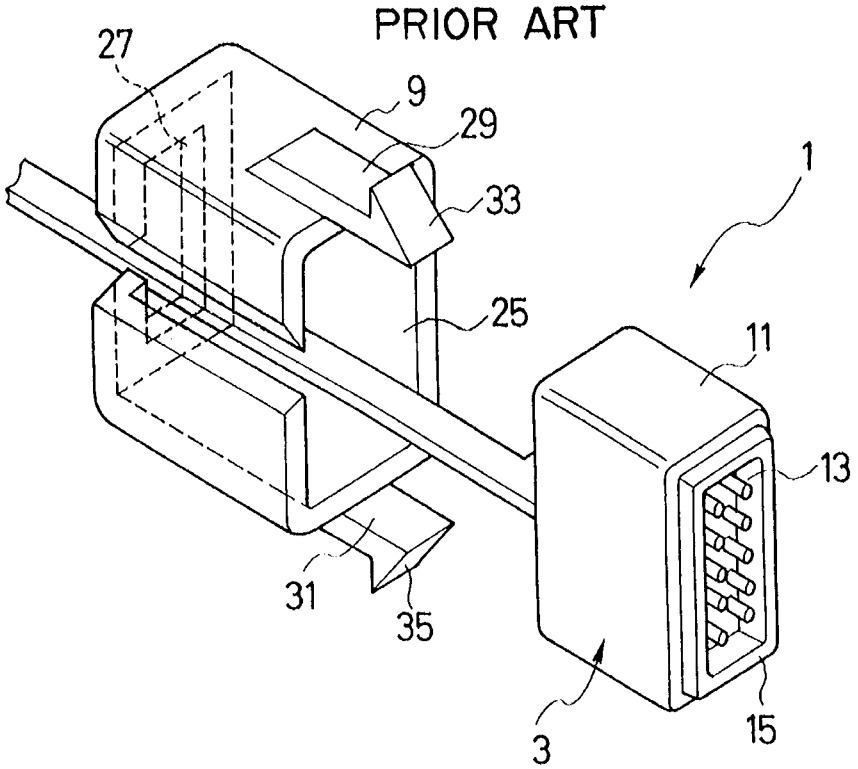
FIG. 1A PRIOR ART
Figure 1B:
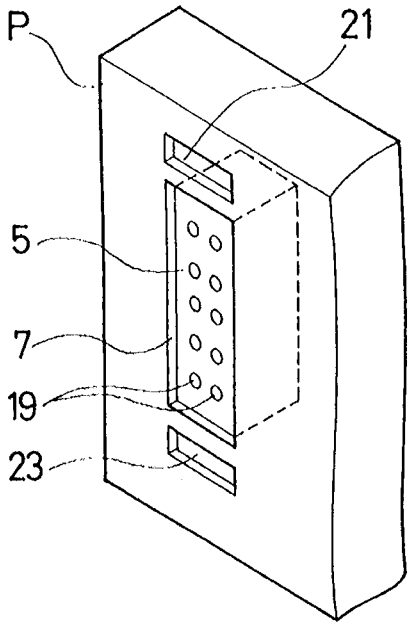
FIG. 1B PRIOR ART
Figure 2A:
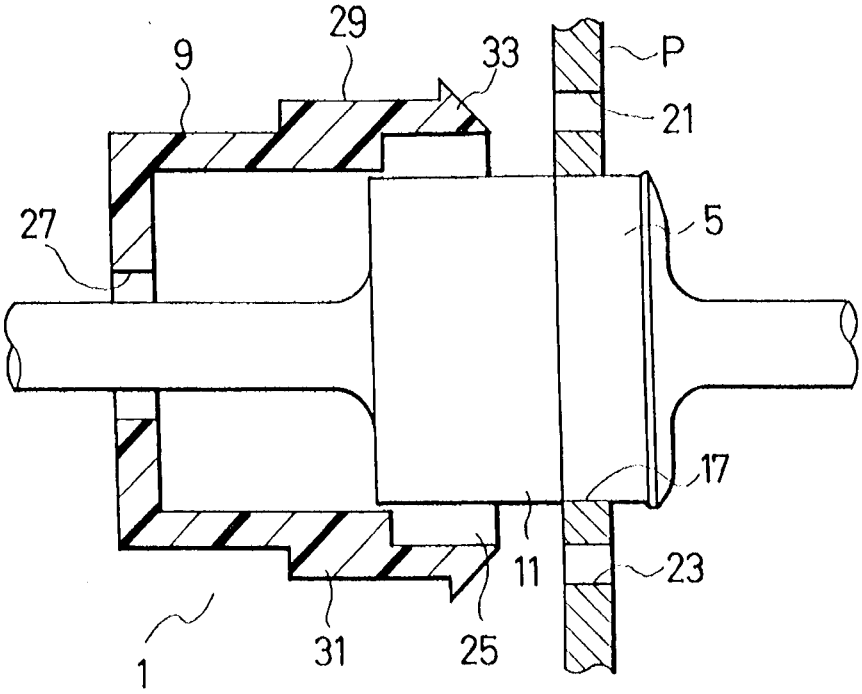
FIG. 2A PRIOR ART
Figure 2B:
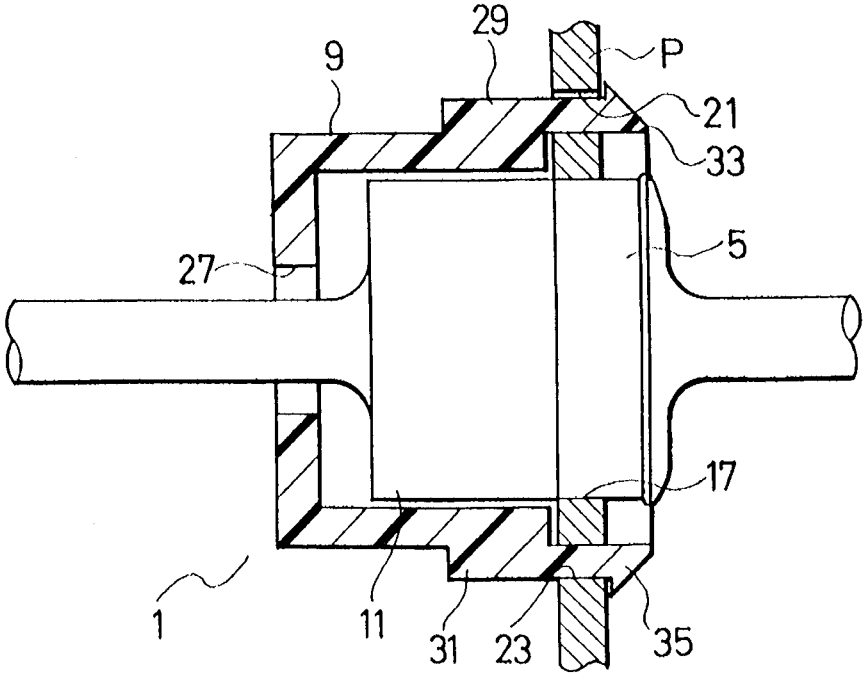
FIG. 2B PRIOR ART
Figure 3:
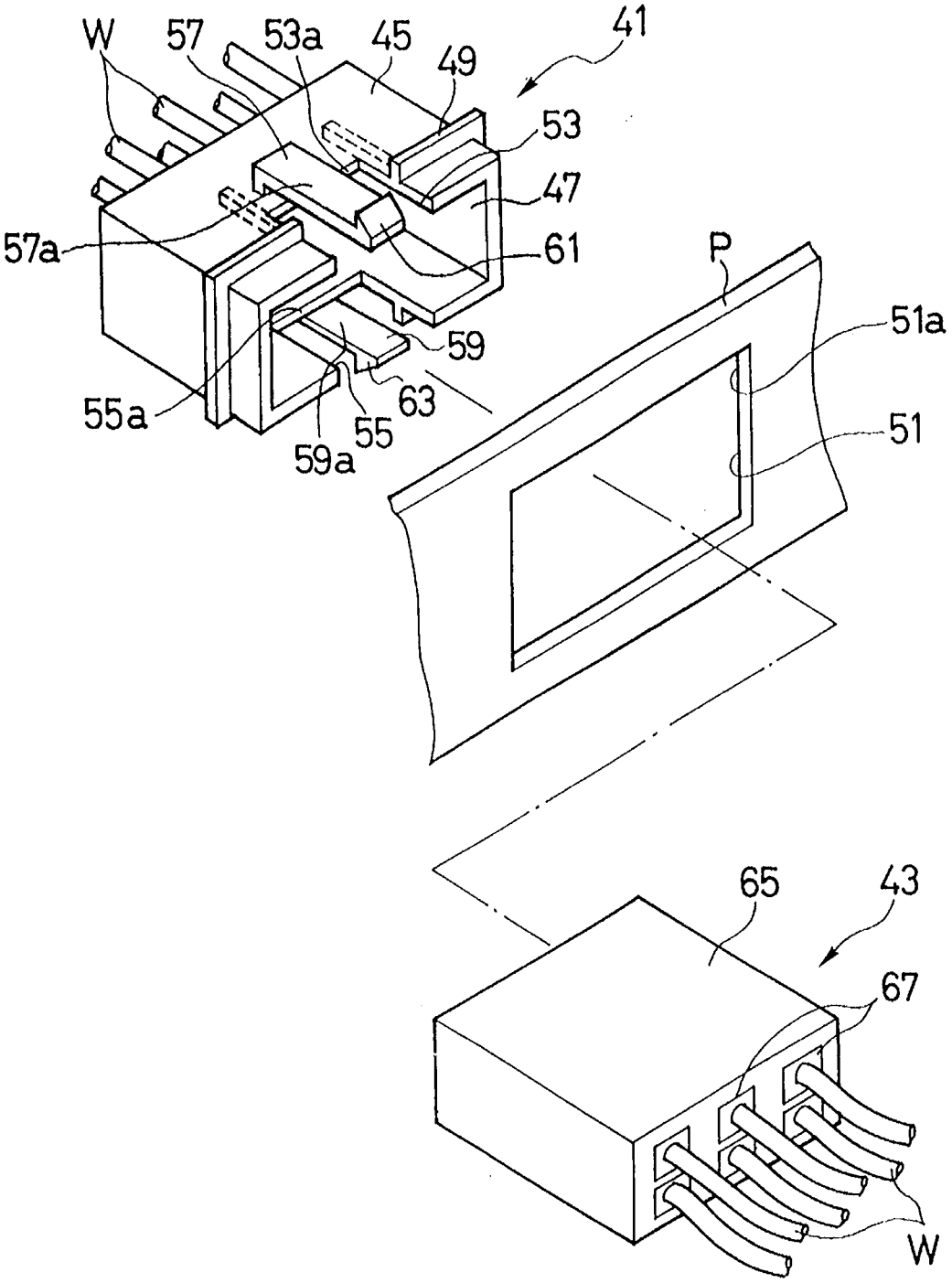
FIG. 3 is an exploded view showing an embodiment of the panel mounted connector according to the present invention.
Figure 4:
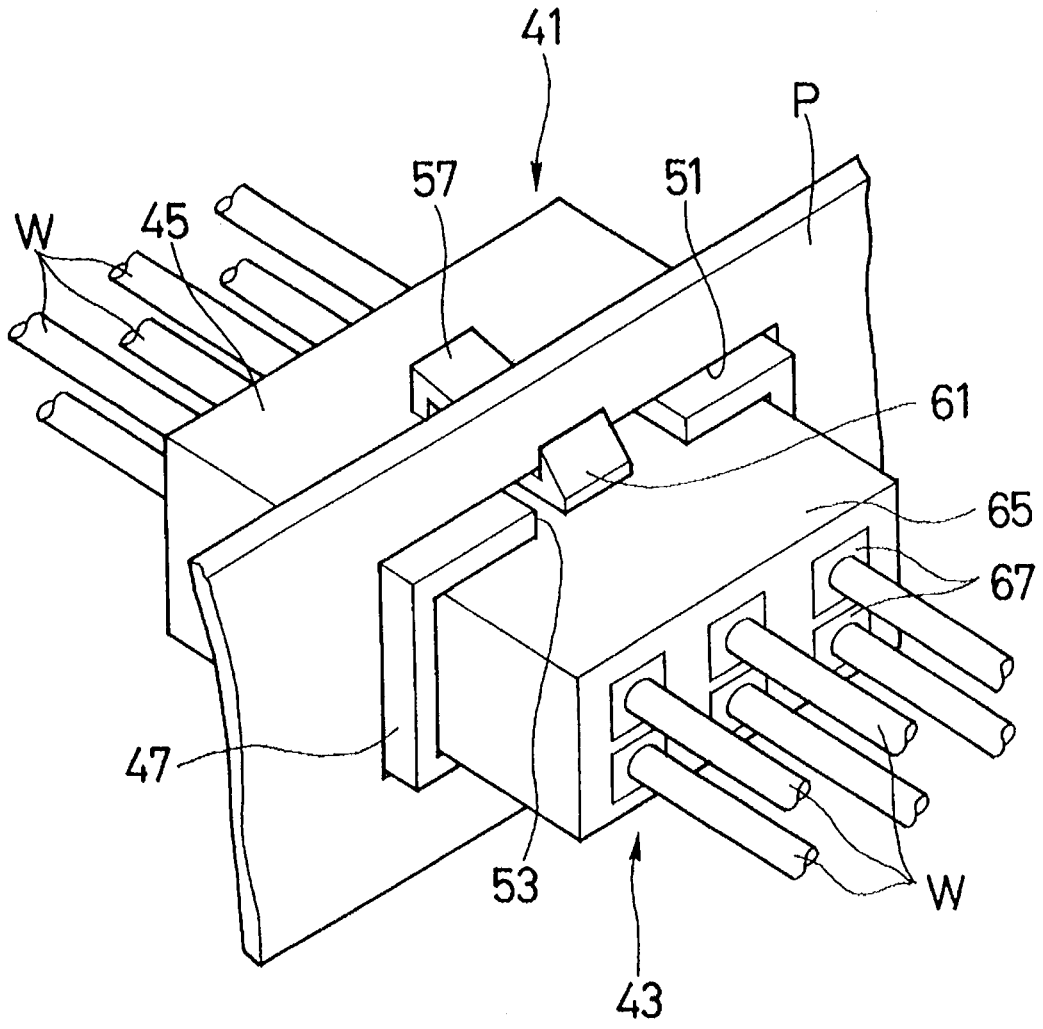
FIG. 4 is a perspective view showing a state where the panel mounted connector according to the present invention is mounted on the panel.

FIG. 3 shows a panel mounted connector (referred to as a female connector, hereinafter) 41, a mated male connector 43 engaged with this female connector 41, and a panel P to which these female and male connectors 41 and 43 are mounted. The female connector 41 is composed of a female connector housing 45 formed with a plurality of terminal accommodating chambers for accommodating a plurality of terminals (not shown) connected to wires W respectively, and an engagement hood portion 47 formed integral with the female connector housing 45 and engaged with the mated male connector 43.

The engage hood portion 47 is formed with a flange-like stopper 49 extending outward from the outer periphery of the engagement hood portion 47. When the female connector 41 is inserted into a rectangular mount opening 51 formed in the panel P, this stopper 49 is brought into contact with tile periphery of the mount opening 51 so that the insertion depth of the female connector 41 into the mount opening 51 can be predetermined. Further, the engagement hood portion 47 is formed with two opposing rectangular hood cutout portions 53 and 55 on both the side walls thereof. Further, the female connector housing 45 is formed with two flexible lock arms 57 and 59 extending from the female connector housing and paralled with the hood cutout portions 53 and 55. These-flexible lock arms 57 and 59 have an arm portion 57*a* or 59*a* extending along the engagement direction between the female connector 41 and the male connector 43 and an outward extending lock claw 61 or 63 formed at the free end thereof. Further, inner wall surfaces 53*a* of the two hood cutout portions 53 and 55 serve as a stopper for preventing the flexible lock arm 57 or 59 from being deformed excessively inward, respectively.

On the other hand, the male connector 43 is formed by a connector housing 65 formed with a plurality of terminal accommodating chambers 67 for accommodating a plurality of terminals connected to wires W respectively.

Figure 5A:
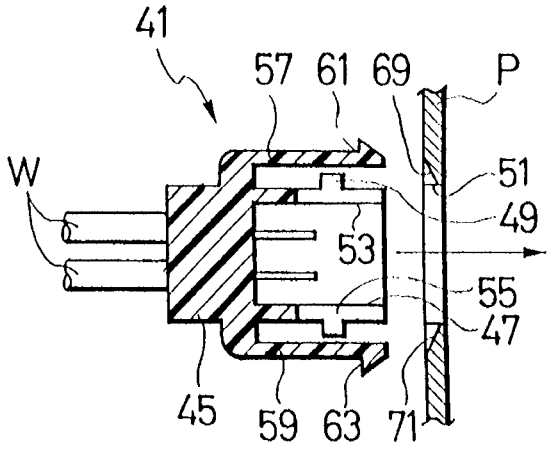
Figure 5B:
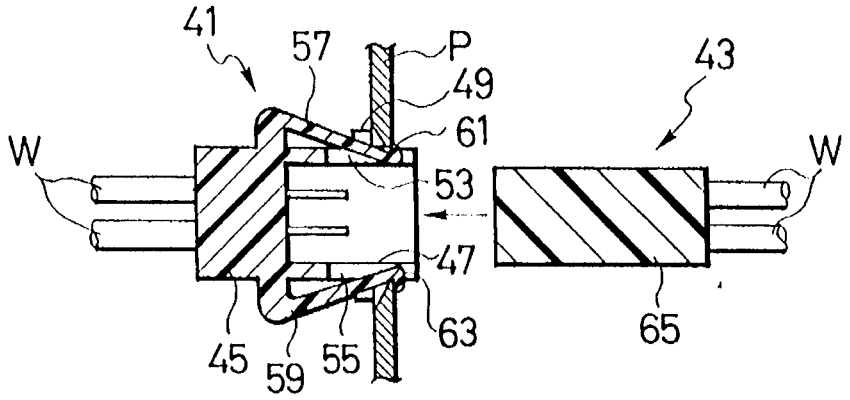
Figure 5C:
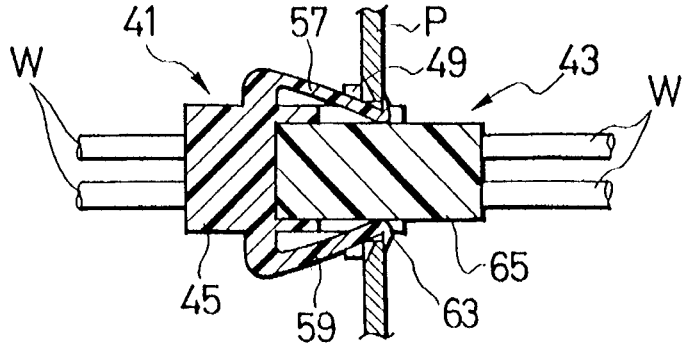

Further, the rectangular mount opening 51 formed in the panel P is chamfered at least on upper and lower edge portions 51*a* thereof so as to form taper surfaces 69 and 71, as shown in FIG. 5A. The dimensions of the panel mount opening 51 are determined to be slightly larger than the outer dimensions of the engagement hood portion 47 of the female connector 41 and less than stopper 49.

When the female connector 41 constructed as described above is mounted into the panel mount opening 51, the female connector 41 is first positioned on the side of the panel on which the taper surfaces 69 and 71 are formed open, and then moved toward the panel mount opening 51 under the condition that the two flexible lock arms 57 and 59 are slightly deformed inward and toward the hood cutout portions 53 and 55. Then, since the end portions of the lock claws 61 and 63 are slidably guided along the taper surfaces 69 and 71 of the panel mount opening 51, the flexible lock arms 57 and 59 are further deformed, so that the flexible lock arms 57 and 59 can be inserted into the panel mount opening 51 and further the lock claws 61 and 63 thereof can be locked with the opening edge 51*a* of the reverse side of the panel mount opening 51. Under these conditions, the ends of the flexible lock arms 57 and 59 are located within the hood cutout portions 53 and 55, respectively. Under these conditions, the mated male connector 43 is engaged with the engagement hood portion 47 of the female connector 41 from the reverse side of the panel P. Once the mated male connector 43 is engaged with the engagement hood portion 47 of the female connector 41, since the flexible lock arms 57 and 59 (deformed inward into the hood cutout portions 53 and 55 of the female connector housing 45, respectively) can be pinched between the inner walls of the panel mount opening 51 and the outer peripheral surfaces of the mated male connector 43, the flexible lock arms 57 and 59 are prevented from being further deformed and thereby it is possible to increase the locking force of the flexible lock arms 57 and 59 to the panel P.

When the female connector 41 is required to be removed once from the panel P, the mated male connector 43 is removed out of the engagement hood portion 47, and then the flexible lock arms 57 and 59 are deformed relatively largely inward into the engagement hood portion 47 to unlock the lock claws 61 and 63 form the opening edge of the reverse side of the panel mount opening 51. Under these conditions, when the female connector 41 is moved away from the panel P, it is possible to remove the female connector 41 from the panel P. In this removal of the female connector 41, since the flexible lock arms 57 and 59 can be removed from the panel mount opening 51 without applying an excessive force to the lock arms, the flexible lock arms 57 and 59 or the lock claws 61 and 63 will not be damaged. Accordingly, when the female connector 41 is required to be mounted to the panel P again, it is possible to mount the female connector 41 repeatedly to the panel P in the same procedure as already explained. In addition, under the conditions that the flexible lock arms 57 and 59 are locked with the panel mount opening 51, since the flexible lock arms 57 and 59 are both housed within the hood cutout portions 53 and 55 of the female connector housing 45, it is possible to mount the female connector 41 to the panel P within a small space.

Figure 6:
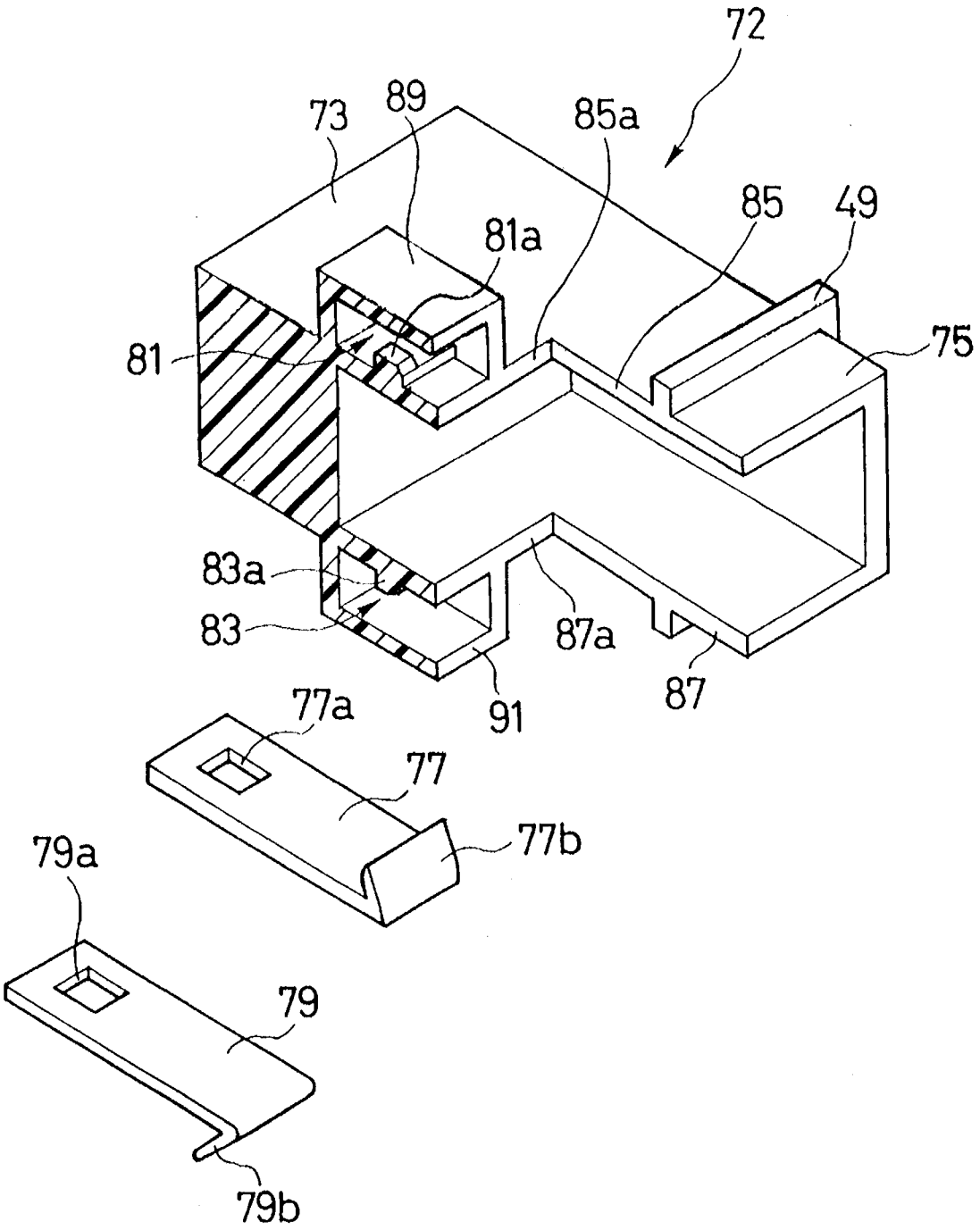
FIG. 6 is an exploded view showing another embodiment of the panel mounted connector according to the present invention.

FIG. 6 shows a second embodiment of the present invention. In the first embodiment shown in FIGS. 3 to 5C, the flexible lock arms 57 and 59 are both formed integral with the female connector housing 45. In this second embodiment, however, two metallic lock arms 77 an 79 are coupled to two coupling portions 81 and 83 formed in a female connector housing 73, respectively. In more detail, as shown in FIG. 6, the two separate plate-like lock arms 77 and 79 have a rectangular engagement hole 77*a* or 79*a* and a bent end lock claw portion 77*b* or 79*b*, respectively. These lock arms 77 and 79 are coupled to the coupling portions 81 and 83 formed in the female connector housing 73 of a panel mounted female connector 72, separately.

In more detail, in the coupling portion 81 or 83, a support wall 89 or 91 opened toward a hood cutout portion 85 or 87 is formed integral with the connector housing 78. Further, an engagement projection 81*a* or 83*a* is formed so as to project from the connector housing 73 and to be covered with the support wall 89 or 91, respectively. These engagement projections 81*a* and 83*a* are engaged with the engagement holes 77*a* and 79*a* of tile lock arms 77 and 79, respectively.

In the panel mounted connector as described above, when locked with the panel mount opening 51, the lock arms 77 and 79 are both housed within the hood cutout portions 85 and 87 respectively. Further, the deformation of these lock arms 77 and 79 can be restricted when the mated male connector 43 is engaged with the engagement hood portion 75 of the female connector 72. In addition, the inner walls 85*a* and 87*a* of the hood cutout portions 85 and 87 serve as a stopper for prevention of the lock arms 77 and 79 from an excessive deformation, respectively.

Further, in this second embodiment, since the lock arms 77 and 79 can be formed of metal, it is possible to increase the locking force to the panel P, as compared with the first embodiment.

As described above, in the panel mounted connector according to the present invention, since the hood cutout portions are formed in the female connector housing, when the female connector is mounted to the panel, the lock arms can be deformed inward into the hood cutout portion of the engage hood portion of the female connector housing thereof, so that it is possible to mount the female connector to the panel in a small space. Further, when the mated male connector is engaged with the panel mounted-female connector, since the deformation of the lock arms can be restricted between the mated male connector housing and the panel within the cutout portions of the female connector housing, it is possible to increase the locking force of the panel mounted female connector to the panel. Further, even after the panel mounted female connector has been removed from the panel, since the lock arms will not be damaged, it is possible to securely mount the female connector to the panel repeatedly.

What is claimed is:

1. A panel mounted connector removably mountable to an opening of a panel, comprising:

a male connector; and a female connector mated with said male connector, including:

a female connector housing formed with an engagement hood portion having an inner cavity engaged with said male connector and an outer periphery engaged with the opening of the panel, the engagement hood portion being further formed with a pair of hood cutout portions; and a pair of flexible lock arms displaced outwardly from and joined to the female connector housing outer periphery and extending parallel to and outwardly of said engagement hood portion in an engagement direction between said male and female connectors, each respective lock arm being formed with a lock claw engageable with an edge of the opening of the panel at a free end thereof for locking said female connector with the panel, whereby when locked with the panel opening, said lock claws are kept pinched between and abut said engaged male connector and the edge of the panel opening, wherein an end of each lock arm is biased inwardly within the respective hood cutout portion formed in the engagement hood portion.

2. The panel mounted connector of claim 1, wherein said female connector housing is further formed with a stopper portion extending peripherally outward from the engagement hood portion, for limiting intrusion of said female connector housing into the panel opening.

3. The panel mounted connector of claim 2, wherein said flexible lock arms are formed integral with said female connector housing.

4. The panel mounted connector of claim 3, wherein said flexible lock arms are formed with an arm portion extending in an engagement direction between said male and female connectors, respectively.

5. The panel mounted connector of claim 1, wherein said flexible lock arms are formed with an arm portion extending in an engagement direction between said male and female connectors, respectively.

6. The panel mounted connector of claim 1, wherein each of said hood cutout portions formed in the engagement hood portion forms a stopper to prevent excessive inward deformation of a respective flexible lock arm associated with said cutout portion.

7. A panel mounted connector removably mountable to an opening of a panel, comprising:

a male connector; and a female connector mated with said male connector, including:

a female connector housing formed with an engagement hood portion having an inner cavity engaged with said male connector and an outer periphery engaged with the opening of the panel, the engagement hood portion being further formed with a pair of hood cutout portions; and a pair of flexible lock arms each formed with a lock claw engageable with an edge of the opening of the panel at a free end thereof, for locking said female connector with the panel, whereby when locked with the panel opening, said lock claws are kept pinched between and directly contacting said engaged male connector and the edge of the panel opening, wherein an end of each lock arm is located within the hood cutout portions formed in the engagement hood portion, wherein said female connector housing is further formed with a stopper portion extending outward from the engagement hood portion, for locating said female connector housing engaged with the panel opening, and wherein said lock arms are removably attached to the engagement hood portion of said female connector housing.

8. The panel mounted connector of claim 7, wherein each of said lock arms is formed into a planer shape and formed with a lock hole at an end portion remote from the lock claw; and the engagement hood portion is further formed with two opposing support walls and an engagement projection under each support wall, for locating the end portion of each of said respective lock arms.

9. The panel mounted connector of claim 7, wherein said lock arms are formed of metal.

10. The panel mounted connector of claim 7, wherein said lock arms are formed with an arm portion extending in an engagement direction between said male and female connectors.

11. The panel mounted connector of claim 7, wherein each of said hood cutout portions formed in the engagement hood portion forms a stopper to prevent excessive inward deformation of a respective flexible lock arm associated with said cutout portion.

12. A panel mounted connector removably mountable to a panel opening, comprising:

a male connector; and a female connector mated with said male connector, including:

a female connector housing formed with an engagement hood portion having an inner cavity engaged with said male connector and an outer periphery engaged with the opening of the panel, the engagement hood portion being further formed with a pair of hood cutout portions; and a pair of flexible lock arms each extending outwardly from the female connector housing for a minor portion of their respective lengths to an elbow and then extending parallel to and outwardly of said engagement hood for a major portion of their respective lengths in an engagement direction between said male and female connectors, each respective lock arm being terminated at a free end thereof with a lock claw engageable with an edge of the opening of the panel opening, for locking said female connector with the panel, whereby when locked with the panel opening, each lock claw is kept pinched between and adjoining said engaged male connector and directly contacting the edge of the panel opening, wherein an end of each lock arm is biased inwardly within a respective hood cutout portion.

13. The panel mounted connector of claim 12, wherein each of said hood cutout portions formed in the engagement hood portion forms a stopper to prevent excessive inward deformation of a respective flexible lock arm associated with said cutout portion.

* * * * *